US009599083B2

(12) United States Patent
Ishii et al.

(10) Patent No.: US 9,599,083 B2
(45) Date of Patent: Mar. 21, 2017

(54) FUEL INJECTION VALVE

(71) Applicant: Hitachi Automotive Systems, Ltd., Hitachinaka-shi, Ibaraki (JP)

(72) Inventors: Eiji Ishii, Tokyo (JP); Motoyuki Abe, Tokyo (JP); Yoshihito Yasukawa, Tokyo (JP); Kiyotaka Ogura, Hitachinaka (JP); Hideharu Ehara, Hitachinaka (JP); Tohru Ishikawa, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/765,489

(22) PCT Filed: Jan. 24, 2014

(86) PCT No.: PCT/JP2014/051436

§ 371 (c)(1),
(2) Date: Aug. 3, 2015

(87) PCT Pub. No.: WO2014/119471

PCT Pub. Date: Aug. 7, 2014

(65) Prior Publication Data

US 2015/0377202 A1 Dec. 31, 2015

(30) Foreign Application Priority Data

Feb. 4, 2013 (JP) ..... 2013-019059

(51) Int. Cl.
*B05B 1/30* (2006.01)
*F02M 63/00* (2006.01)
(Continued)

(52) U.S. Cl.
CPC .... *F02M 63/0077* (2013.01); *F02M 51/0671* (2013.01); *F02M 61/12* (2013.01);
(Continued)

(58) Field of Classification Search
CPC .... F02M 55/008; F02M 55/04; F02M 51/061; F02M 69/50; F02M 61/184; F02M 61/06; F02M 61/1866
(Continued)

(56) References Cited

U.S. PATENT DOCUMENTS

2007/0095952 A1* 5/2007 Heinstein ..... F02M 51/0671 239/585.1
2007/0272772 A1* 11/2007 Lambert ..... F02M 61/1873 239/533.12
(Continued)

FOREIGN PATENT DOCUMENTS

JP 2007-107459 A 4/2007
JP 3941109 B2 7/2007
(Continued)

OTHER PUBLICATIONS

Japanese Office Action issued in counterpart Japanese Application No. 2013-019059, dated Jan. 8, 2016, with unverified English translation (eleven (11) pages).
(Continued)

*Primary Examiner* — Davis Hwu
(74) *Attorney, Agent, or Firm* — Crowell & Moring LLP

(57) ABSTRACT

In a fuel injection valve used in an internal combustion engine, fuel spray travel distance is shortened.
There is provided a fuel injection valve including a seat member, in which the seat member includes a conical seat surface that seats fuel by coming in contact with a valve body, and inlet opening portions of a plurality of fuel injection holes on the conical seat surface, and is configured such that an axis of the injection hole connecting the centers of an inlet and an outlet of the fuel injection hole is along a plurality of different conical surfaces, and in which, in an outlet section that is configured of a plane parallel to an inlet section of the inlet opening portion of the fuel injection hole
(Continued)

and is positioned at the outlet of the fuel injection hole, the seat member includes the injection hole in which a major axis direction of an ellipse of the outlet section has an inclination angle of greater than 0 degrees with respect to a straight line in a fuel injection direction, which is obtained by projecting the axis of the injection hole on the outlet section, and an inclination angle of a degree before being perpendicular to the straight line in the fuel injection direction.

5 Claims, 12 Drawing Sheets

(51) Int. Cl.
*F02M 51/06* (2006.01)
*F02M 61/12* (2006.01)
*F02M 61/18* (2006.01)

(52) U.S. Cl.
CPC ..... *F02M 61/184* (2013.01); *F02M 61/188* (2013.01); *F02M 61/1813* (2013.01); *F02M 61/1833* (2013.01); *F02M 61/1846* (2013.01); *F02M 61/1873* (2013.01); *F02M 63/0078* (2013.01)

(58) Field of Classification Search
USPC ..... 239/533.12, 585.1, 585.3, 585.4, 585.5
See application file for complete search history.

(56) References Cited

U.S. PATENT DOCUMENTS

| | | | | |
|---|---|---|---|---|
| 2009/0020633 | A1* | 1/2009 | Limmer | F02M 61/1806 239/533.12 |
| 2009/0230219 | A1* | 9/2009 | Matsumura | F02M 61/1853 239/533.12 |
| 2010/0193612 | A1* | 8/2010 | Schrade | F02M 51/0671 239/533.12 |
| 2010/0320293 | A1 | 12/2010 | Ogura et al. | |
| 2012/0104121 | A1 | 5/2012 | Watanabe et al. | |
| 2013/0313339 | A1 | 11/2013 | Carpenter et al. | |

FOREIGN PATENT DOCUMENTS

| | | | |
|---|---|---|---|
| JP | 2007-247620 | A | 9/2007 |
| JP | 2008-14216 | A | 1/2008 |
| JP | 2006-208817 | A | 9/2008 |
| JP | 4196194 | B2 | 12/2008 |
| JP | 4306656 | B2 | 8/2009 |
| JP | 2010-112196 | A | 5/2010 |
| JP | 2011-1864 | A | 1/2011 |
| JP | 5134063 | B2 | 1/2013 |
| JP | 2014-504699 | A | 2/2014 |
| WO | WO 2012/106512 | A2 | 8/2012 |

OTHER PUBLICATIONS

International Search Report (PCT/ISA/210) dated Apr. 28, 2014, with English translation (Four (4) pages).

* cited by examiner

FUEL INJECTION VALVE

TECHNICAL FIELD

The present invention relates to a fuel injection valve that is used in an internal combustion engine such as a gasoline engine, and to a fuel injection valve in which fuel leakage is prevented by a valve coming in contact with a valve seat, and the fuel is injected by the valve separating from the valve seat.

BACKGROUND ART

In the related art, a technique is disclosed in which, a flow route of the fuel is not bent while the fuel flowing into a fuel injection hole reaches an outlet from an inlet of the fuel injection hole, and atomization of the injected fuel is promoted by obtaining the expansion and contraction of the volume without particularly increasing the discharging pressure of a fuel pump. In recent years, the regulations of exhaust gas of automobiles have been strengthened, and internal combustion engines of automobiles have been required to reduce particulate matter such as harmful exhaust gas HC (hydrocarbon) or soot. This exhaust matter is generated in such a manner that the fuel adhering to a wall surface in a cylinder or an intake valve due to impact causes an unburnt state so that the flame has difficulty propagating, or the fuel becomes locally rich. In order to suppress such circumstances, it is necessary to shorten the spray itself so that the spray does not collide with the wall surface in the cylinder, and to improve a degree of freedom for laying out the spray so that the spray does not collide with the intake valve and the like. In the related art, in the injection hole, the sectional area of a flow path of the fuel is changed in a flowing direction, swirling velocity components are generated in the section perpendicular to a central axis of the injection hole (regardless of velocity components in an injection direction), and the spray is diffused by the swirling velocity components when the fuel is injected from the injection hole. As a result, the spray can be shortened.

CITATION LIST

Patent Literature

PTL 1: JP-A-2010-112196

SUMMARY OF INVENTION

Technical Problem

In the invention of the related art, the distribution of the swirling velocity components in the injection hole is symmetric with respect to the injection direction (the distribution of the swirling velocity components in a section is symmetric with respect to a straight line that is obtained by projecting a central axis line of the injection hole on the section of the injection hole), and as a result, the swirling velocity components, of which the directions are opposite to each other, cancel each other. Therefore, there is a problem in that a diffusion effect of the spray may not be sufficiently obtained.

An object of the invention is to provide a fuel injection device which can reduce the amount of fuel adhering to an intake valve or a wall surface in a cylinder when the fuel is directly injected in the cylinder so as to reduce the emission amount of harmful substances, and has a high degree of freedom for configuring the shape of spray and a short fuel spray travel distance.

Solution to Problem

In order to solve the problem described above, in the invention, various means described below are used.

There is provided a fuel injection valve including: a seat member, in which the seat member includes a conical seat surface that seats fuel by coming in contact with a valve body, and inlet opening portions of a plurality of fuel injection holes on the conical seat surface, and in which, in an outlet section that is configured of a plane parallel to an inlet section of the inlet opening portion of the fuel injection hole and is positioned at an outlet of the injection hole, the seat member includes the injection hole in which a major axis direction of an ellipse of the outlet section has an inclination angle of greater than 0 degrees to a degree perpendicular to a straight line in a fuel injection direction, which is obtained by projecting an axis of the injection hole on the outlet section.

Advantageous Effects of Invention

According to the invention, it is possible to provide a fuel injection valve that causes an internal combustion engine to be implemented which can shorten a fuel spray travel distance, can prevent adhering on an intake valve by improving layout properties of spray, and enhances exhaust performance.

Objects, configurations, and effects other than those described above are clarified with the description of the following embodiments.

DESCRIPTION OF EMBODIMENTS

First Embodiment

The fuel injection valve according to the first embodiment of the invention will be described with reference to FIGS. 1 to 7 and FIGS. 11 and 12.

Figure 1:
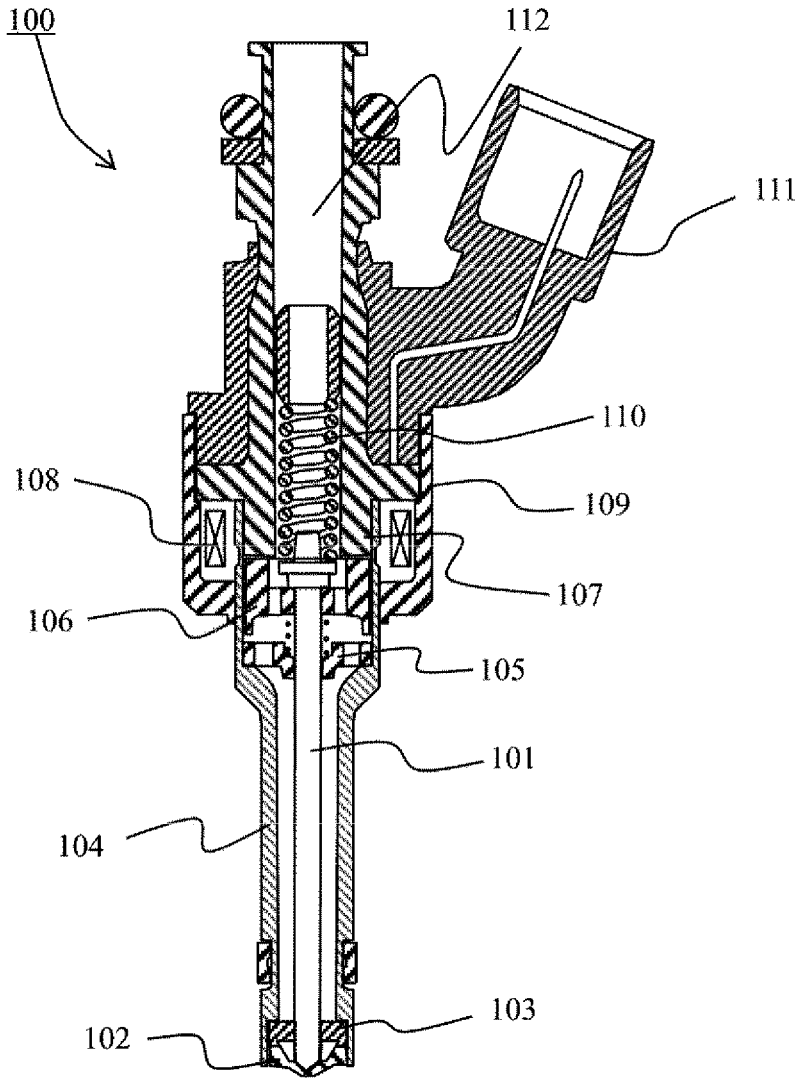
FIG. 1 is a sectional view illustrating an embodiment of a fuel injection valve according to the invention.

An electromagnetic fuel injection valve 100 illustrated in FIG. 1 is an example of an electromagnetic fuel injection valve for a cylinder direct injection type gasoline engine. However, the effect of the invention can be effective for an electromagnetic fuel injection valve for a port injection type gasoline engine or a fuel injection valve driven by piezoelectric elements or magnetostrictive elements.

(Description of Basic Operation of Injection Valve)

In FIG. 1, fuel is supplied from a fuel supply port 112 and is supplied to the inside of the fuel injection valve. The electromagnetic fuel injection valve 100 illustrated in FIG. 1 is an electromagnetically driven fuel injection valve of a normally closed type. When a coil 108 is not electrically conducted, a valve body 101 is biased by a spring 110 so as to be pressed against a seat member 102, and thus the fuel is sealed. At this time, in the fuel injection valve for cylinder injection, the pressure of the fuel to be supplied is in a range of about 1 MPa to 35 MPa.

Figure 2:
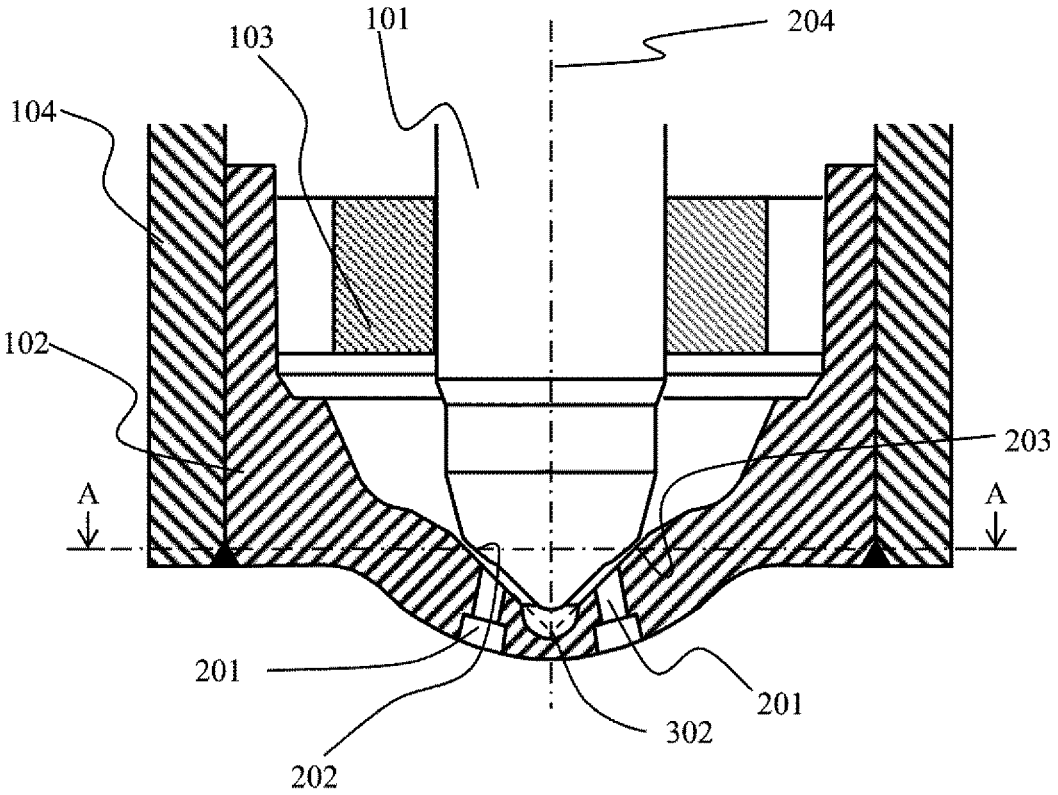
FIG. 2 is a sectional view illustrating the vicinity of a tip of a valve body of a fuel injection valve of a first embodiment according to the invention in an enlarged manner.

FIG. 2 is a sectional view illustrating the vicinity of the injection hole provided on the tip of the valve body in an enlarged manner. When the fuel injection valve is in a closed-valve state, the valve body 101 is in contact with a valve seat surface 203, which is configured by a conical surface provided on the seat member 102 bonded to a nozzle body 104 by welding or the like, and thus the sealing of the fuel is secured. At this time, the contact portion on the valve body 101 side is formed by a spherical surface 202, and the contact between the valve seat surface 203 of the conical surface and the spherical surface 202 is almost line contact. When the coil 108 illustrated in FIG. 1 is electrically conducted, the magnetic flux density is generated in a core 107, a yoke 109, and an anchor 106 that configure a magnetic circuit of an electromagnetic valve, and thus magnetic attraction is generated in a space between the core 107 and the anchor 106. When the magnetic attraction is increased to be larger than the biasing force of the spring 110 and a force by the pressure of the fuel described above, the valve body 101 is attracted to the core 107 side by the anchor 106 while being guided by the guide member 103 and the valve body guide 105 and thus is in an opened-valve state.

In the opened-valve state, a gap is generated between the valve seat surface 203 and the spherical surface portion 202 of the valve body, and the fuel starts to be injected. When the fuel starts to be injected, the energy applied as the pressure of the fuel is converted into kinetic energy, and thus the fuel reaches the fuel injection hole 201 to be injected.

Figure 3:
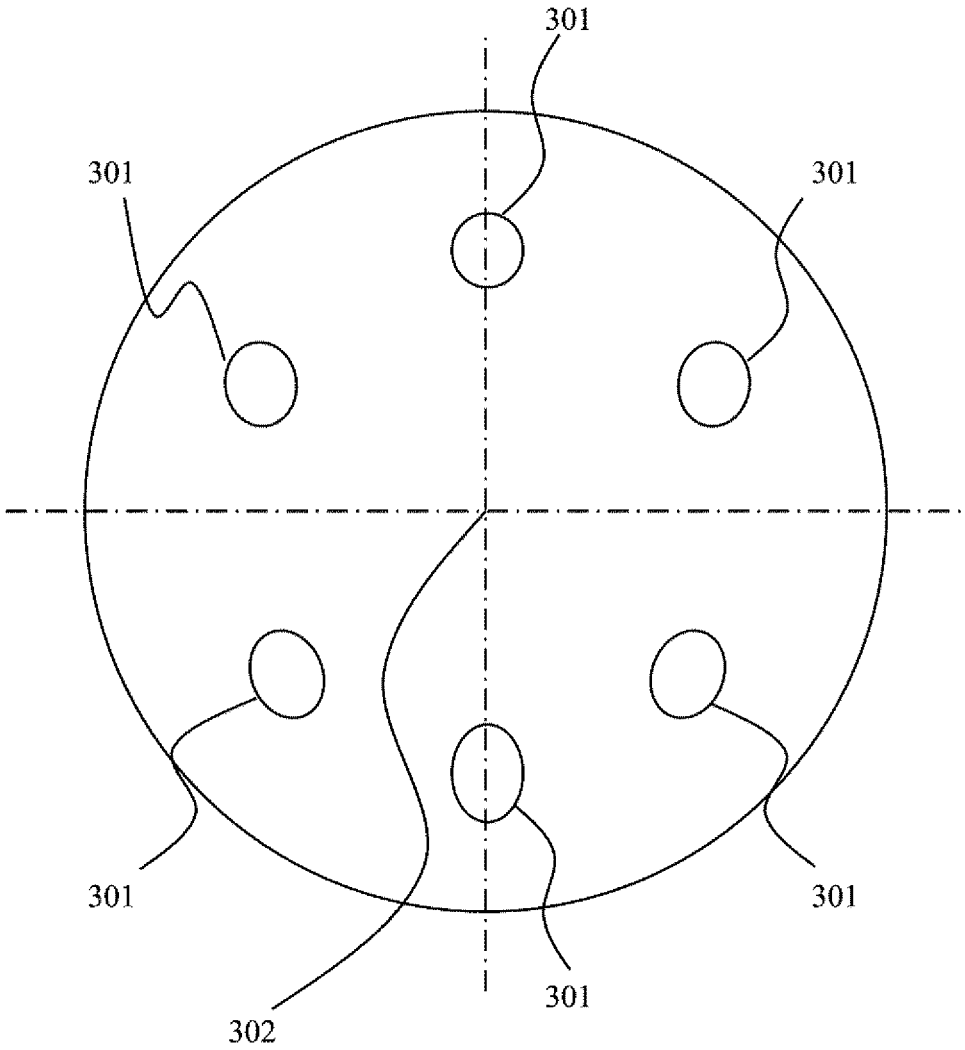
FIG. 3 is an example of arrangement of injection holes when lower end portions of a nozzle body in FIG. 1 are seen from the below.

FIG. 3 is an example of arrangement of injection holes when lower end portions of the seat member 102 in FIG. 1 are seen from below. Six injection holes 301 are arranged with an intersection point 302 as the center, which is between a central axis 204 of the fuel injection valve in a vertical direction and the lower end portion of the seat member 102.

(Description of Flowing Effect)

Figure 4:
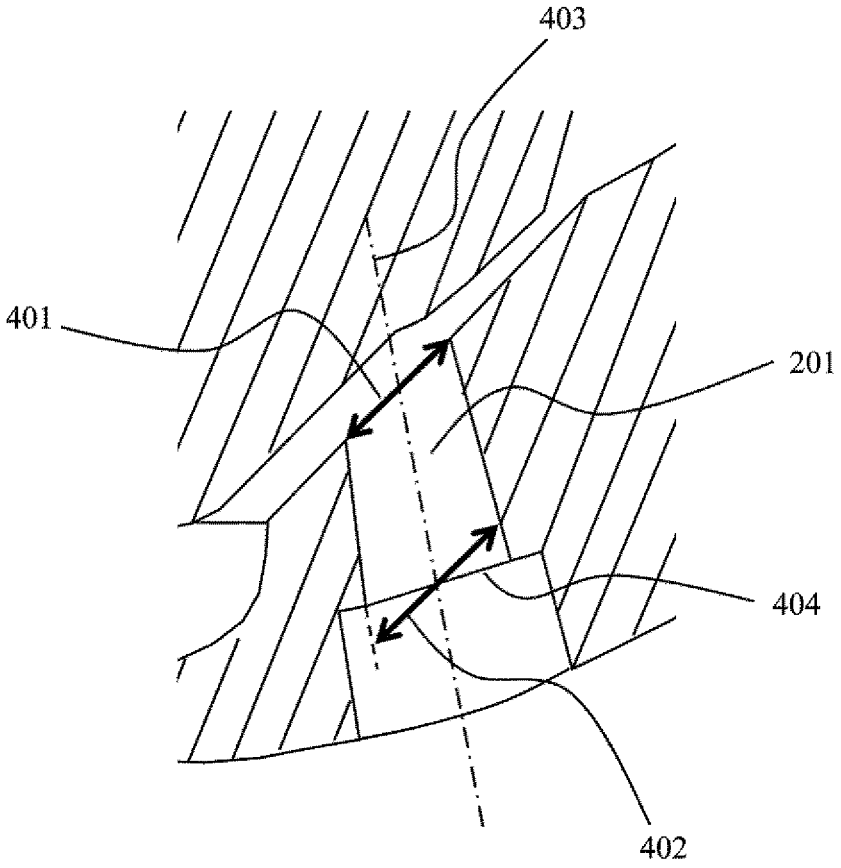
FIG. 4 is an example in which the invention is applied to the injection hole arranged on the lower end portion of the nozzle body in FIG. 2.

FIG. 4 is an example in which the invention is applied to the injection hole 201 arranged on the lower end portion of the seat member 102 in FIG. 2. The ranges of arrows illustrated in FIG. 4 illustrate an inlet section 401 and an outlet section 402 of an inlet opening portion of the injection hole 201. The outlet section 402 is configured of a plane parallel to the inlet section 401. The center of the inlet section 401 and the outlet section 402 matches the central axis 403 of the injection hole 201, and the outlet section 402 includes an intersection point between a substantial outlet opening portion 404 of the injection hole 201 and the central axis 403 of the injection hole.

Figure 5:
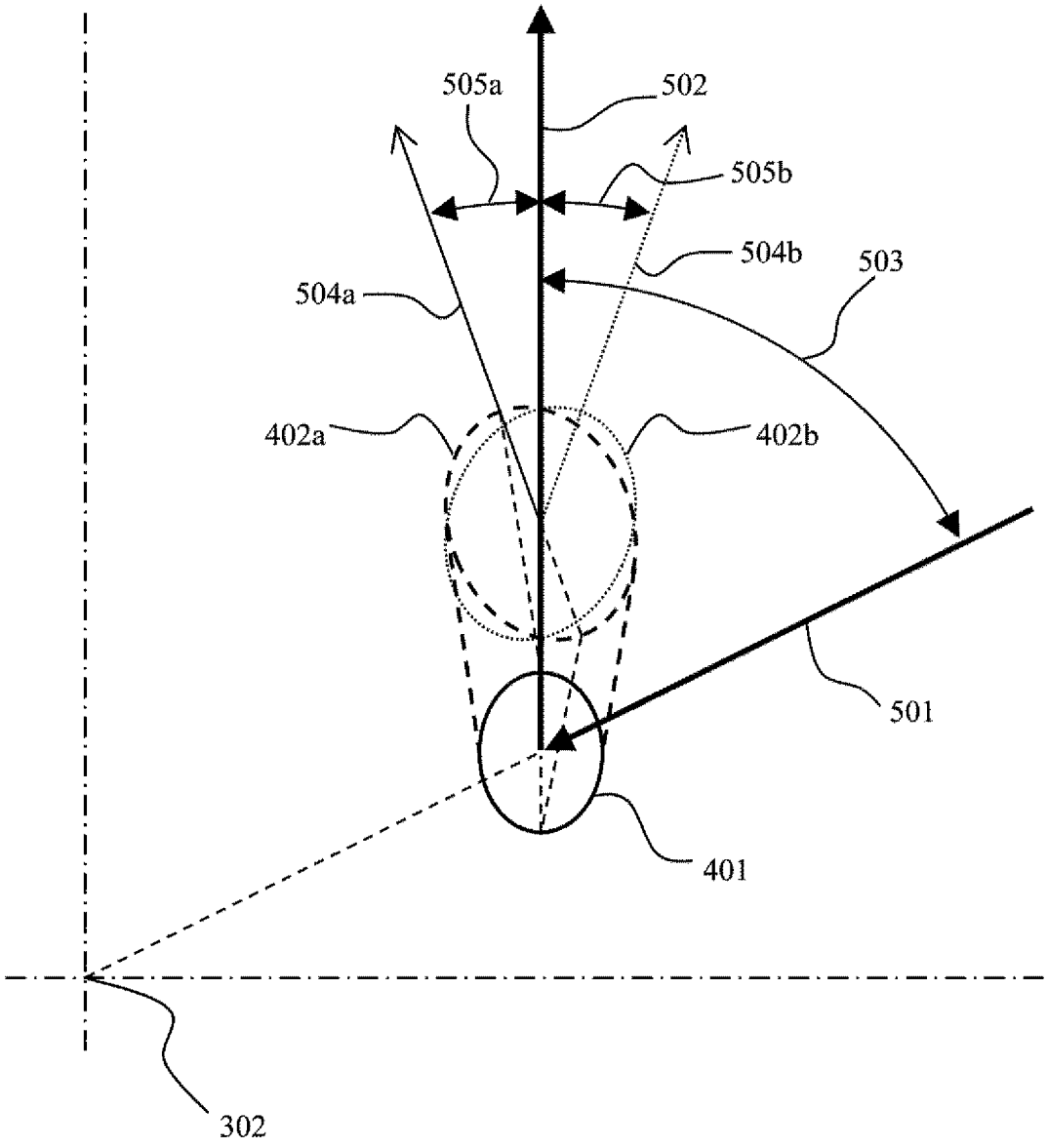
FIG. 5 illustrates an inlet section of the injection hole and an outlet section of the injection hole when the injection hole, to which the invention is applied, in FIG. 4 is seen from the inlet side toward the outlet side of the injection hole (First Embodiment).

FIG. 5 illustrates a positional relationship between the inlet section 401 of the injection hole and the outlet section 402 of the injection hole when the injection hole, to which the invention is applied, in FIG. 4 is seen from the inlet side toward the outlet side of the injection hole. The inlet section 401 and the outlet section 402 are configured to have an elliptical shape. Major axis directions 504*a* and 504*b* of ellipses of the outlet section 402 have an inclination angle β 505 larger than 0 degrees, with respect to a fuel injection direction 502, which is illustrated by a straight line obtained by projecting the central axis 403 of the injection hole on the outlet section. The inclination angle β 505 is an inclination angle in which the elliptical shape of the outlet section is not line-symmetric with respect to (perpendicular to) the straight line indicating the fuel injection direction 502 (that is, β has a value (505*a* of FIG. 5) between 0 degrees and 90 degrees, and β has a value in a clockwise direction (505*b* in FIG. 5) in addition to the value in a counterclockwise direction illustrated in FIG. 5).

The fuel flows in the inlet section 401, first, from a flowing direction 501 toward the center 302 of the seat member 102. Then, in the injection hole, the fuel flows toward the fuel injection direction 502, and then the fuel is injected from the injection hole. A twisting angle α 503 is defined by the flowing direction 501 toward the inlet section 401 and the injection direction 502.

Figure 6:
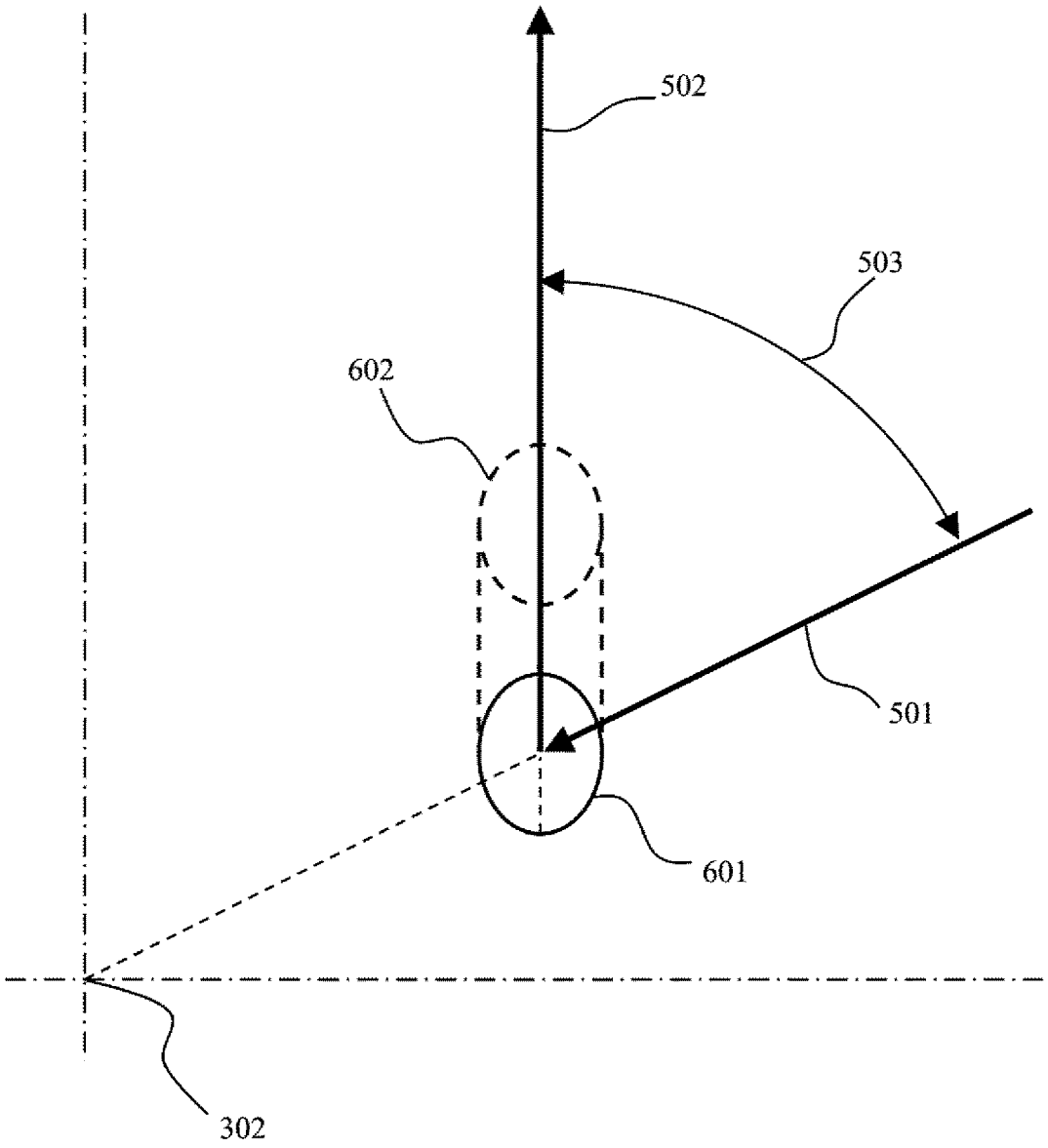
FIG. 6 illustrates an inlet section of an injection hole and an outlet section of the injection hole in the related art, which corresponds to FIG. 5.

Meanwhile, FIG. 6 illustrates a relationship between an inlet section 601 and an outlet section 602 in the related art. In the related art, a major axis direction of an ellipse of the inlet section 601 and a major axis direction of an ellipse of the outlet section 602 match the fuel injection direction 502. The inclination angle β is 0 degrees.

Figure 11:
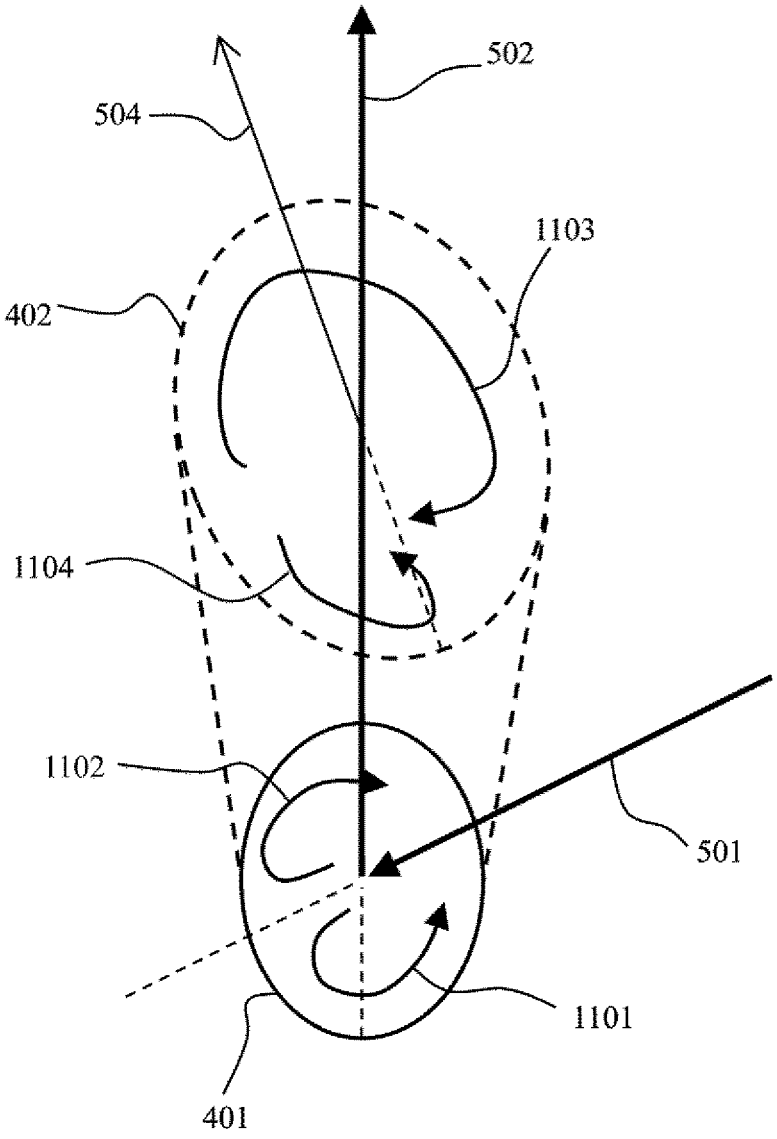
FIG. 11 illustrates swirling velocity components in the inlet section of the injection hole and the outlet section of the injection hole of FIG. 5.

The effect of the invention will be described with reference to FIG. 11. Arrows in the drawing illustrate swirling velocity components in the section of the inlet section 401 and the outlet section 402. In the section of the inlet section 401, a swirling velocity component 1101 and a swirling velocity component 1102 are formed to be almost line-symmetric with respect to the flowing direction 501. In addition, in the outlet section 402, a swirling velocity distribution having different strengths of a swirling velocity component 1103 and a swirling velocity component 1104 is generated in the section by the action of the twisting angle α 503, which is defined by the flowing direction 501 and the injection direction 502 illustrated in FIG. 5, and the inclination angles β 505*a* and 505*b*, which are defined between the injection direction 502 and the major axis directions

Figure 7:
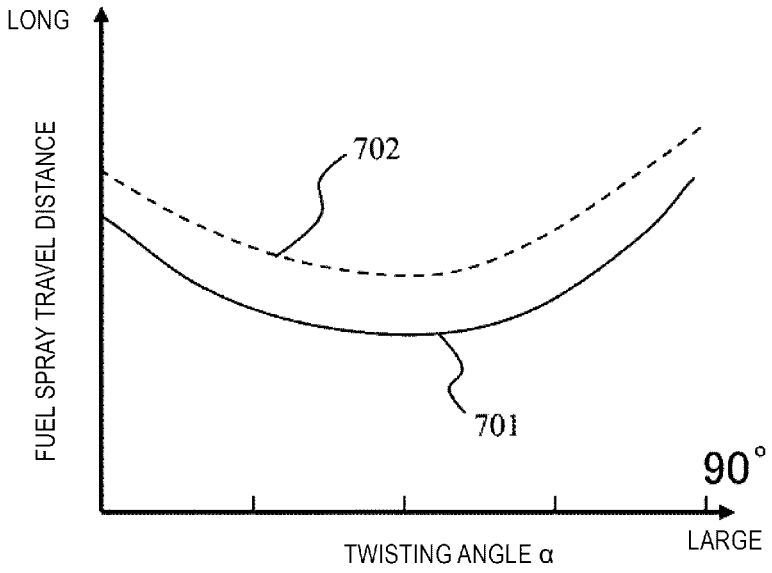
FIG. 7 is a diagram illustrating a shortening effect of a fuel spray travel distance according to the invention.
Figure 12:
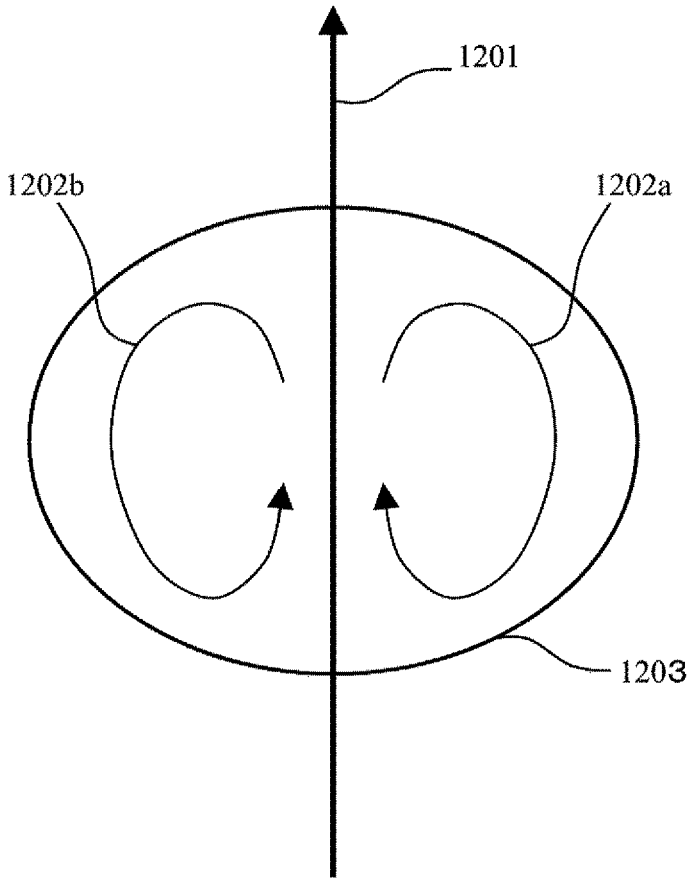
FIG. 12 illustrates swirling velocity components in the outlet section of the injection hole in the related art.

504*a* and 504*b* of the outlet section 402. After injection, the swirling velocity components having a different strength do not become zero by canceling each other in the atmosphere, and result in the shortening of the fuel spray travel distance by obtaining the diffusion effect of the spray. FIG. 7 illustrates an effect of the twisting angle α 503 and the inclination angle β 505 on the fuel spray travel distance. A fuel spray travel distance 702 is decreased as the twisting angle α 503 is increased, and is transited to be increased after reaching a minimum distance. Meanwhile, by adding the effect of the inclination angle β 505, the entire fuel spray travel distance at the twisting angle α 503 can be shortened as indicated by 701 compared to a case of the inclination angle β of 0 degrees. Therefore, the twisting angle α can cause the fuel spray travel distance to be effectively shortened even in a case of the injection hole of 0 degrees or 180 degrees. As illustrated in FIG. 12 of the related art, when the twisting angle α 503 is 0 degrees or 180 degrees, in an outlet section 1203, swirling velocity components 1202*a* and 1202*b* are formed to be line-symmetric with respect to an injection direction 1201. The line-symmetrical swirling velocity components have an action for canceling each other after the fuel injection. Therefore, the diffusion effect of the spray becomes weak, and thus the fuel spray travel distance becomes longer.

According to the invention, it is possible to shorten the fuel spray travel distance, and also it is possible to promote the atomization of spray liquid droplets. According to the invention, it is possible to obtain the diffusion effect of spray, and thus the contact area between the fuel and the air is increased. As a result, a shearing effect by the air is increased and thus the atomization of the spray is promoted. In addition, in FIG. 8, an effect of an end-widened flow path in which the sectional area of the injection hole is increased in an outlet direction, and an effect of the inclination angle β 505 are combined, and thus great effects of the shortening of the fuel spray travel distance and the promoting of the atomization of the spray can be obtained. These effects are similar in other embodiments.

Figure 10:
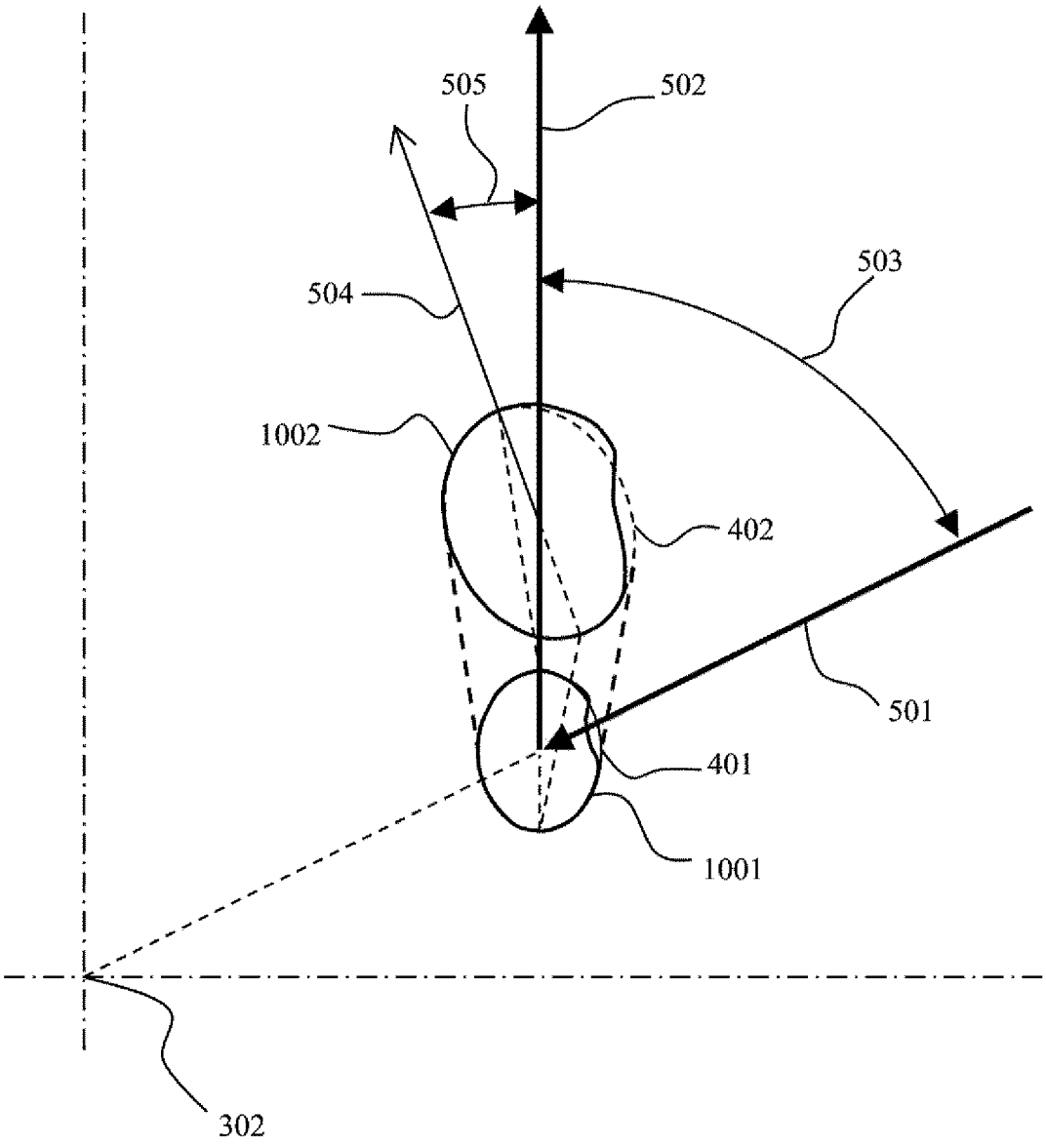
FIG. 10 illustrates an inlet section of the injection hole and an outlet section of the injection hole when the injection hole, to which the invention is applied, in FIG. 4 is seen from the inlet side toward the outlet side of the injection hole (an example to which the first embodiment is applied).

The shape of the injection hole exemplified in the embodiment can be processed by applying a laser along the elliptic outlines of the outlet section and the inlet section, in laser processing. In addition, in the embodiment, a case in which the inlet section and the outlet section of the injection hole have an elliptical shape is described, but even in a case in which apart of the elliptic outline is made uneven as illustrated in FIG. 10, the same operational effect can be obtained. Further, in the embodiment, the inlets of the fuel injection hole on the seat surface are configured to be arranged at approximately equal intervals with the same distance from the central axis of the fuel injection valve. However, even when the inlets of the fuel injection hole have different distances from the central axis of the fuel injection valve and different intervals from each other, the operational effect of the embodiment is not impaired. In addition, in the embodiment, a case in which the number of fuel injection holes is six is described, but when the number of fuel injection holes is different from six, the same operational effect is obtained and the effect is not impaired. Similarly, in a case of a configuration in which the number of fuel injection holes is the same as that of the example, and the spray shape is different from that of the embodiment, the operational effect according to the invention is not impaired.

Second Embodiment

Figure 8:
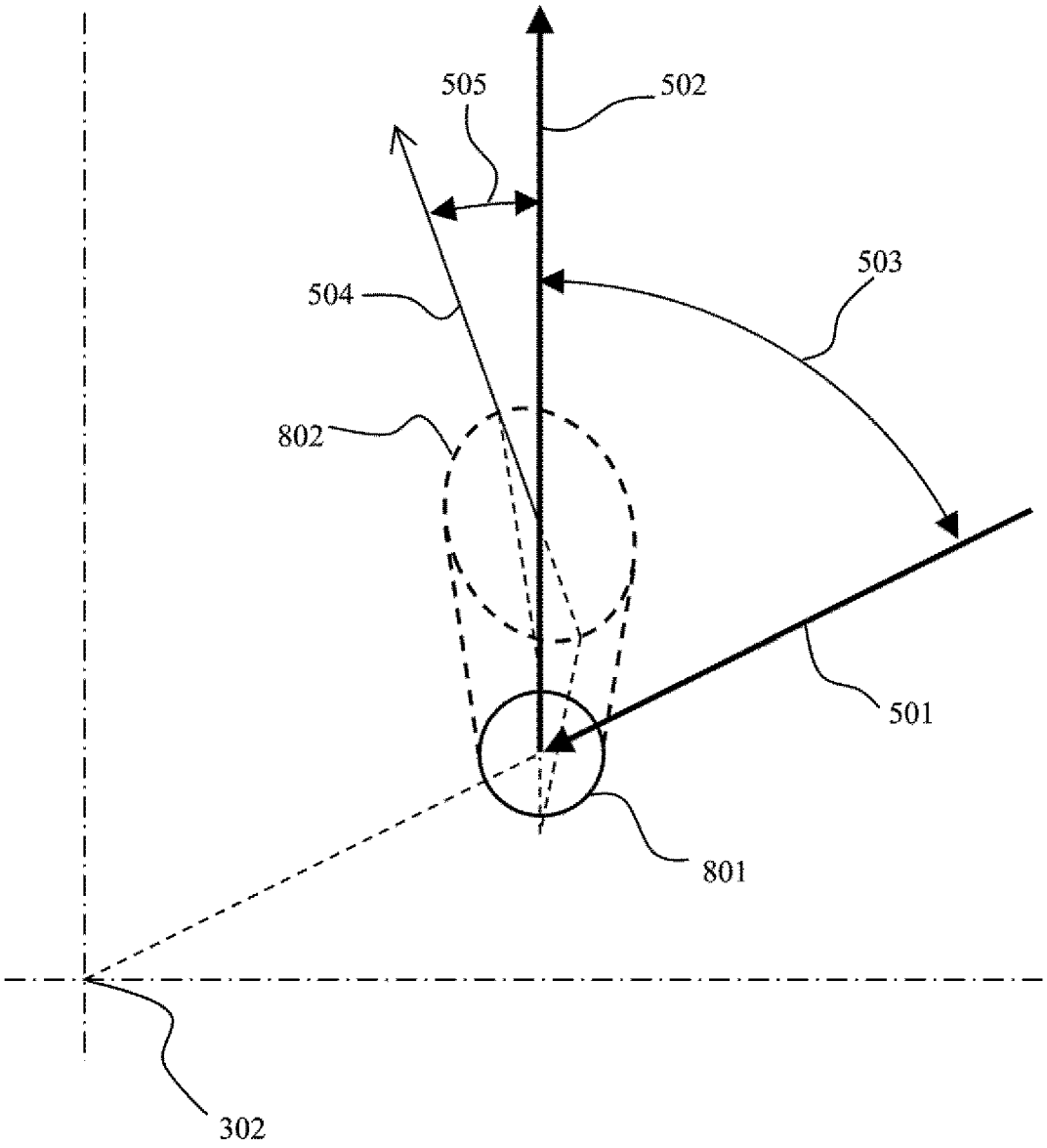
FIG. 8 illustrates an inlet section of the injection hole and an outlet section of the injection hole when the injection hole, to which the invention is applied, in FIG. 4 is seen from the inlet side toward the outlet side of the injection hole (Second Embodiment).

A fuel injection valve according to a second embodiment of the invention will be described with reference to FIGS. 3, 5, and 8. FIG. 8 illustrates a positional relationship between an inlet section 801 and an outlet section 802 of the injection hole in the embodiment, components to which the same reference signs as those used in the first embodiment are assigned have the same or equivalent functions as in the first embodiment, and thus the description thereof is omitted.

In FIG. 8, the inlet section 801 of the injection hole is configured to have a perfect circle shape. The effects of the invention will be described below. FIG. 3 is an example of arrangement of injection holes when lower end portions of the seat member 102 in FIG. 1 are seen from the below, but the injection holes have different injection directions. Therefore, the inlet sections of the injection holes are different for each injection hole. As a result, the flowing amounts of injection from each injection hole are caused to be different for each injection hole. If the shape of the inlet section of the injection hole is an elliptical shape, the entrance loss varies due to the fuel flowing direction 501 illustrated in FIG. 5 and thus the flowing amount of the injection is changed. In the invention, it is possible to prevent the flowing amount of the injection of each injection hole from being changed by making the inlet section of each injection hole have a perfect circle shape as illustrated in FIG. 8. In addition, when the inlet section 801 is made to have a perfect circle shape, the increasing rate of the sectional area toward the outlet section 802 is increased, and since the curvature of the inner wall of the injection hole is constant in a perfect circle, the swirling velocity component illustrated in the first embodiment is strengthened. Therefore, it is possible to further enhance the diffusion effect of the spray. Accordingly, in combination with the effect of the swirling velocity component in an outlet section by the inclination angle β 505, which is defined by the major axis direction 504 of the outlet section 802 and the injection direction 502 described in the first embodiment, it is possible to further shorten the fuel spray travel distance.

In the embodiment, a case is described in which the inlet section of the injection hole has a perfect circle shape and the outlet section has an elliptical shape, but even in a case where a part of the outline of the perfect circle and the ellipse is made uneven as illustrated in FIG. 10, the same operational effect is obtained.

Third Embodiment

Figure 9:
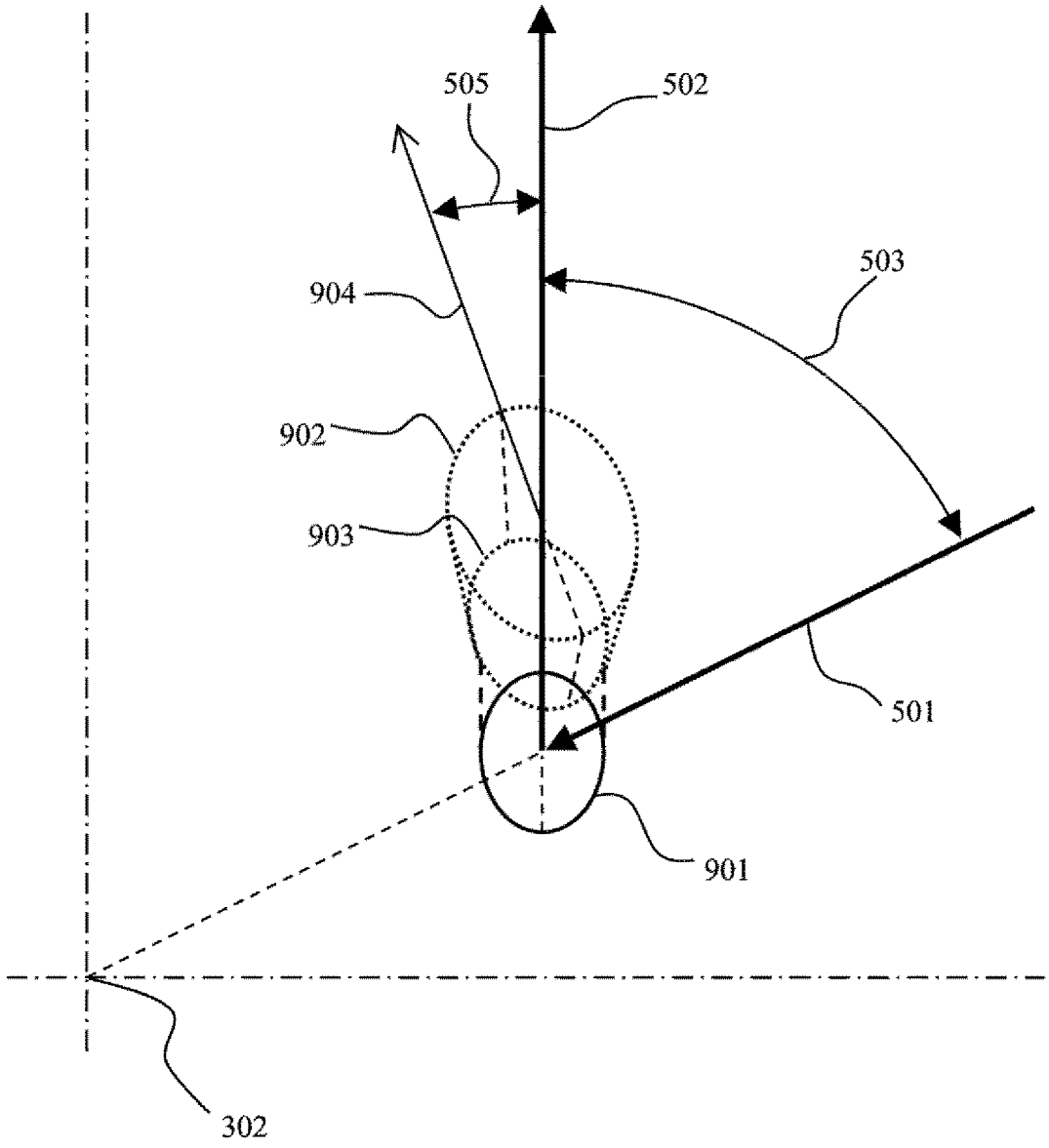
FIG. 9 illustrates an inlet section of the injection hole and an outlet section of the injection hole when the injection hole, to which the invention is applied, in FIG. 4 is seen from the inlet side toward the outlet side of the injection hole (Third Embodiment).

A fuel injection valve according to a third embodiment of the invention will be described with reference to FIG. 9. FIG. 9 illustrates a positional relationship between an inlet section 901 and an outlet section 902 of the injection hole in the embodiment, components to which the same reference signs as those used in the first embodiment are assigned have the same or equivalent functions as in the first embodiment, and thus the description thereof is omitted.

In FIG. 9, the injection hole is configured by two flow paths. A first flow path is formed to be an elliptic cylinder obtained by sliding a section having the same area as the inlet section in an outlet direction with the axis of the injection hole as a center, and a second flow path is formed to be a tapered shape in which the sectional area of the flow path increases as the flow path goes from an inlet side toward an outlet side. Further, a major axis 904 of an ellipse of the outlet section 902 of a part having a tapered shape has the inclination angle β 505 with respect to the injection direction 502. Even in the structure exemplified in the embodiment, it is possible to obtain the same effect as the invention illustrated in the first embodiment.

Further, similarly to the case illustrated in the second embodiment, when the inlet section 901 of the injection hole illustrated in FIG. 9 is made to have a perfect circle shape, it is possible to obtain the same effect as that in the second embodiment.

In the embodiment, a case is described in which the inlet section and the outlet section of the injection hole have an elliptical shape, but even in a case in which a part of the elliptic outline is made uneven as illustrated in FIG. 10, the same operational effect can be obtained.

The shape of the injection hole illustrated in the embodiment can be processed by using a punch in addition to the laser processing. Formation can be performed in such a manner that, first, the injection hole is opened from the inlet side with an elliptic-cylinder-shaped pin, and then a tapered-shaped pin is pressed against the injection hole from the outlet side.

The invention illustrated by using the first, second, and third embodiments can further shorten the fuel spray travel distance by using the following schemes.

A first scheme is a method of increasing the flowing rate at a seat portion that is positioned on the upstream side of the injection hole. Since the direction of the flowing at the seat portion on the upstream side of the injection hole is approximately parallel to the inlet section of the injection hole, the flowing rate at the seat portion is increased, and the swirling velocity component of the inlet section also becomes faster. As a result, the diffusion effect of the spray is increased and the fuel spray travel distance is shortened.

A second scheme is a method of correcting the speed distribution on the upstream side of the seat portion by using a swirl flow or the like. As described in the first to third embodiments, the formation of the swirling velocity component in the injection hole is affected by the twisting angle α 503 formed by the fuel flowing direction toward the inlet section of the injection hole and the fuel injection direction. It is possible to control the twisting angle α 503 by changing the fuel flowing direction toward the inlet section of the injection hole by using the swirl flow for the speed distribution on the upstream side of the seat portion. Therefore, it is possible to shorten the fuel spray travel distance.

REFERENCE SIGNS LIST

100 ELECTROMAGNETIC FUEL INJECTION VALVE
101 VALVE BODY
102 SEAT MEMBER
103 GUIDE MEMBER
104 NOZZLE BODY
105 VALVE BODY GUIDE
106 NEEDLE
107 MAGNETIC CORE
108 COIL
109 YOKE
110 BIASING SPRING
111 CONNECTOR
112 FUEL SUPPLY PORT
201 INJECTION HOLE
202 SPHERICAL SURFACE OF VALVE BODY
203 VALVE SEAT SURFACE
204 CENTRAL AXIS OF FUEL INJECTION VALVE IN VERTICAL DIRECTION
401 INLET SECTION
402 OUTLET SECTION
403 CENTRAL AXIS OF INJECTION HOLE
404 OUTLET OPENING PORTION
501 FUEL FLOWING DIRECTION
502 FUEL INJECTION DIRECTION
503 TWISTING ANGLE α
504 MAJOR AXIS DIRECTION OF ELLIPSE OF OUTLET SECTION OF INJECTION HOLE
505, 505*a*, 505*b* INCLINATION ANGLE β
601 INLET SECTION
602 OUTLET SECTION
701 FUEL SPRAY TRAVEL DISTANCE
702 FUEL SPRAY TRAVEL DISTANCE
801 INLET SECTION
802 OUTLET SECTION
901 INLET SECTION
902 OUTLET SECTION
903 A BOUNDARY BETWEEN ELLIPTIC CYLINDER PORTION AND TAPERED PORTION
1001 ELLIPTICAL SHAPE OF INLET
1002 ELLIPTICAL SHAPE OF OUTLET
1101 SWIRLING VELOCITY COMPONENT IN INLET SECTION
1102 SWIRLING VELOCITY COMPONENT IN INLET SECTION
1103 SWIRLING VELOCITY COMPONENT IN OUTLET SECTION
1104 SWIRLING VELOCITY COMPONENT IN OUTLET SECTION
1201 INJECTION DIRECTION OF INJECTION HOLE
1202*a* SWIRLING VELOCITY COMPONENT IN OUTLET SECTION
1202*b* SWIRLING VELOCITY COMPONENT IN OUTLET SECTION
1203 OUTLET SECTION

The invention claimed is:

1. A fuel injection valve comprising:
a valve body; and
a seat member which comes in contact with the valve body, and which is formed with a fuel injection hole, wherein
the fuel injection hole has an inlet opening portion that includes an inlet section and an outlet section,
the inlet section and the outlet section are configured to have an elliptical shape,
major axis directions of ellipses of the outlet section have an inclination angle β that is larger than 0 degrees, with respect to a fuel injection direction obtained by projecting a central axis of the injection hole on the outlet section, and
the inclination angle β is an inclination angle in which the elliptical shape of the outlet section is not line-symmetric with respect to a straight line representing the fuel injection direction, such that β has a value between 0 degrees and 90 degrees, and has a value in a clockwise direction in addition to a value in the counterclockwise direction.

2. The fuel injection valve according to claims 1,
wherein a central axis of the fuel injection hole matches a central axis of the inlet section.

3. The fuel injection valve according to claim 1,
wherein a central axis of the fuel injection hole matches a central axis of the outlet section.

4. The fuel injection valve according to claim 3,
wherein the central axis of the inlet section matches the central axis of the outlet section.

5. The fuel injection valve according to claim 1,
wherein the fuel injection hole is formed by a first flow path on an upstream side, and a second flow path on a downstream side, and the second flow path is formed to be a tapered shape in which a sectional area of the flow path increases as the flow path goes from an inlet side toward an outlet side.

* * * * *